US010288054B2

(12) United States Patent
Lim et al.

(10) Patent No.: US 10,288,054 B2
(45) Date of Patent: May 14, 2019

(54) LINEAR COMPRESSOR

(71) Applicant: LG ELECTRONICS INC., Seoul (KR)

(72) Inventors: Sanghyun Lim, Seoul (KR); Kiwon Noh, Seoul (KR); Jeonguk Byun, Seoul (KR); Yunhyeok Yu, Seoul (KR); Kyungmin Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 86 days.

(21) Appl. No.: 15/584,334

(22) Filed: May 2, 2017

(65) Prior Publication Data

US 2017/0321672 A1 Nov. 9, 2017

(30) Foreign Application Priority Data

May 3, 2016 (KR) ..... 10-2016-0054898

(51) Int. Cl.

| | |
|---|---|
| ***F04B 39/00*** | (2006.01) |
| ***F04B 39/10*** | (2006.01) |
| ***F04B 35/04*** | (2006.01) |
| ***F04B 53/12*** | (2006.01) |
| ***F04B 39/12*** | (2006.01) |

(52) U.S. Cl.

CPC ..... *F04B 39/1073* (2013.01); *F04B 35/045* (2013.01); *F04B 39/0016* (2013.01); *F04B 39/10* (2013.01); *F04B 39/108* (2013.01); *F04B 39/122* (2013.01); *F04B 53/12* (2013.01); *F04B 53/123* (2013.01); *F04B 39/0005* (2013.01)

(58) Field of Classification Search

CPC ..... F04B 39/0016; F04B 39/1073; F04B 35/045; F04B 39/10; F04B 53/12; Y10T 137/784; Y10T 137/789; Y10T 137/7891; Y10T 137/7843

See application file for complete search history.

(56) References Cited

U.S. PATENT DOCUMENTS

| | | | | |
|---|---|---|---|---|
| 303,878 A * | 8/1884 | Noll | F04B 39/0016 417/550 |
| 2,378,613 A * | 6/1945 | Young | F16K 15/144 137/855 |
| 2005/0013717 A1* | 1/2005 | Lee | F04B 39/0016 417/570 |

FOREIGN PATENT DOCUMENTS

| | | |
|---|---|---|
| CN | 1200789 | 12/1998 |
| CN | 1221857 | 7/1999 |
| CN | 1829859 | 9/2006 |
| CN | 107304759 | 10/2017 |

(Continued)

OTHER PUBLICATIONS

European Search Report dated Oct. 4, 2017.
Chinese Office Action dated Jul. 4, 2018 with English Translation.

*Primary Examiner* — Peter J Bertheaud
(74) *Attorney, Agent, or Firm* — Ked & Associates LLP

(57) ABSTRACT

A linear compressor is provided. The linear compressor may include a suction valve with a plurality of wings. Each of the plurality of wings may include two first edge portions that extend in an outer direction of a fixing portion, and a second edge portion forming an outer circumferential portion of the wing. A distance between a first edge portion of a first wing among the plurality of wings and a second edge portion of a second wing among the plurality of wings gradually increases toward the outer direction of the suction valve.

17 Claims, 11 Drawing Sheets

(56) References Cited

FOREIGN PATENT DOCUMENTS

| | | |
|---|---|---|
| EP | 1 022 464 | 7/2000 |
| KR | 10-2005-0017249 | 2/2005 |
| KR | 10-1307688 | 5/2009 |
| KR | 10-2016-0000324 | 1/2016 |
| WO | WO 2004/106737 | 12/2004 |

* cited by examiner

LINEAR COMPRESSOR

CROSS-REFERENCE TO RELATED APPLICATION(S)

The present application claims priority under 35 U.S.C. 119 and 35 U.S.C. 365 to Korean Patent Application No. 10-2016-0054898, filed in Korea on May 3, 2016, which is hereby incorporated by reference in its entirety.

BACKGROUND

1. Field

A linear compressor is disclosed herein.

2. Background

Cooling systems are systems in which a refrigerant circulates to generate cool air. In such a cooling system, processes of compressing, condensing, expanding, and evaporating the refrigerant are repeatedly performed. For this, the cooling system includes a compressor, a condenser, an expansion device, and an evaporator. Also, the cooling system may be installed in a refrigerator or air conditioner which is a home appliance.

In general, compressors are machines that receive power from a power generation device, such as an electric motor or a turbine, to compress air, a refrigerant, or various working gases, thereby increasing pressure. Compressors are being widely used in home appliances or industrial fields.

Compressors may be largely classified into reciprocating compressors, in which a compression space into/from which a working gas is suctioned and discharged, is defined between a piston and a cylinder to allow the piston to be linearly reciprocated into the cylinder, thereby compressing a refrigerant, rotary compressors, in which a compression space into/from which a working gas is suctioned or discharged, is defined between a roller that eccentrically rotates and a cylinder to allow the roller to eccentrically rotate along an inner wall of the cylinder, thereby compressing a refrigerant, and scroll compressors, in which a compression space into/from which a refrigerant is suctioned or discharged, is defined between an orbiting scroll and a fixed scroll to compress a refrigerant while the orbiting scroll rotates along the fixed scroll. In recent years, a linear compressor, which is directly connected to a drive motor, in which a piston linearly reciprocates, to improve compression efficiency without mechanical losses due to movement conversion, and having a simple structure, is being widely developed. In general, the linear compressor may suction and compress a refrigerant while a piston linearly reciprocates in a sealed shell by a linear motor and then discharge the refrigerant.

The linear motor is configured to allow a permanent magnet to be disposed between an inner stator and an outer stator. The permanent magnet may linearly reciprocate by an electromagnetic force between the permanent magnet and the inner (or outer) stator. Also, as the permanent magnet operates in the state in which the permanent magnet is connected to the piston, the permanent magnet may suction and compress the refrigerant while linearly reciprocating within the cylinder and then discharge the refrigerant.

The present applicant has filed a patent (hereinafter, referred to as "Prior Art Document 1") and then has registered the patent with respect to the linear compressor, Korean Patent Registration No. 10-1307688, registered on Sep. 5, 2013 and entitled "LINEAR COMPRESSOR", which is hereby incorporated by reference. The linear compressor according to the Prior Art Document 1 includes a shell for accommodating a plurality of parts. A vertical height of the shell may be somewhat high as illustrated in FIG. 2 of the Prior Art Document 1. Also, an oil supply assembly for supplying oil between a cylinder and a piston may be disposed within the shell.

When the linear compressor is provided in a refrigerator, the linear compressor may be disposed in a machine room provided at a rear side of the refrigerator. In recent years, a major concern of a customer is increasing an inner storage space of the refrigerator. To increase the inner storage space of the refrigerator, it may be necessary to reduce a volume of the machine room. Also, to reduce the volume of the machine room, it may be important to reduce a size of the linear compressor.

However, as the linear compressor disclosed in the Prior Art Document 1 has a relatively large volume, it is necessary to increase a volume of a machine room into which the linear compressor is accommodated. Thus, the linear compressor having a structure disclosed in the Prior Art Document 1 is not adequate for the refrigerator for increasing the inner storage space thereof.

To reduce the size of the linear compressor, it may be necessary to reduce a size of a main part or component of the compressor. In this case, performance of the compressor may deteriorate. To compensate for the deteriorated performance of the compressor, the compressor drive frequency may be increased. However, the more the drive frequency of the compressor is increased, the more a friction force due to oil circulating into the compressor increases, deteriorating performance of the compressor.

To solve these limitations, the present applicant has filed a patent application (hereinafter, referred to as "Prior Art Document 2"), Korean Patent Publication No. 10-2016-0000324 published on Jan. 4, 2016, and entitled "LINEAR COMPRESSOR", which is hereby incorporated by reference. In the linear compressor of the Prior Art Document 2, a gas bearing technology in which a refrigerant gas is supplied in a space between a cylinder and a piston to perform a bearing function is disclosed. The application of the gas bearing technology may reduce friction loss even when a drive frequency of a compressor is increased.

On the other hand, in the linear compressor according to the Prior Art Document 2, a suction valve coupled to a piston is disclosed. The suction valve is configured to selectively open and close a suction hole provided on a front surface of the piston.

However, according to the suction valve, a port part is formed to have a large size so as to open and close a relatively large number of suction holes, whereas a flow hole is formed to have a relatively small size. In this case, a mass of the suction valve increases, thus deteriorating a response performance of the suction valve. Also, as an interval between a plurality of port parts is relatively narrow, that is, as passages of refrigerants discharged through the plurality of suction holes are formed adjacent to each other, a flow resistance between the suctioned refrigerants is deteriorated.

BRIEF DESCRIPTION OF THE DRAWINGS

Embodiments will be described in detail with reference to the following drawings in which like reference numerals refer to like elements, and wherein.

DETAILED DESCRIPTION

Hereinafter, exemplary embodiments will be described with reference to the accompanying drawings. The embodiments may, however, be embodied in many different forms and should not be construed as being limited to the embodiments set forth herein; rather, that alternate embodiments included in other retrogressive inventions or falling within the spirit and scope of the present disclosure will fully convey the concept to those skilled in the art.

Figure 1:
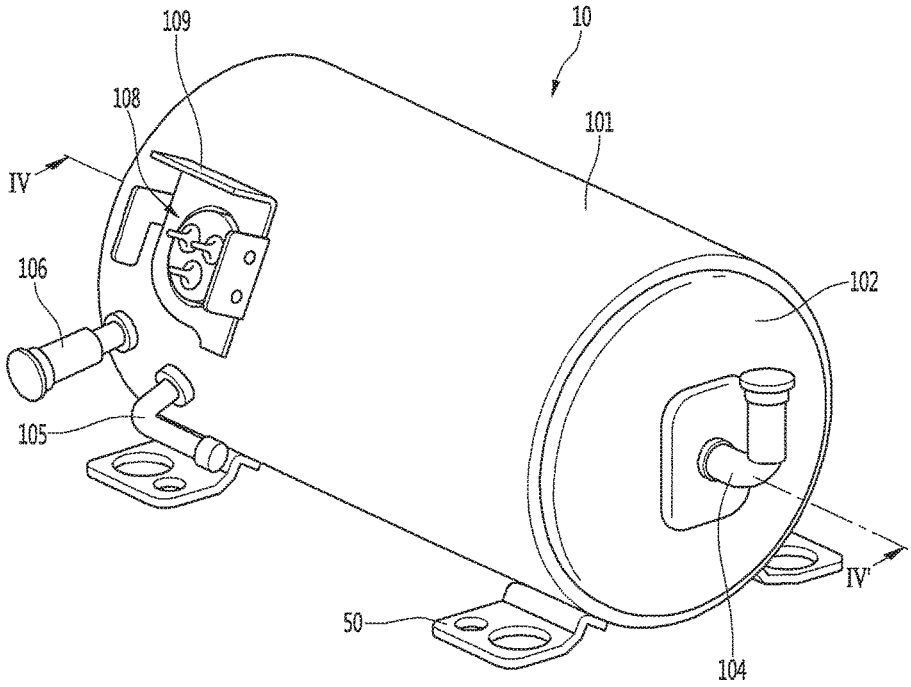
FIG. 1 is a perspective view illustrating an outer appearance of a linear compressor according to an embodiment.
Figure 2:
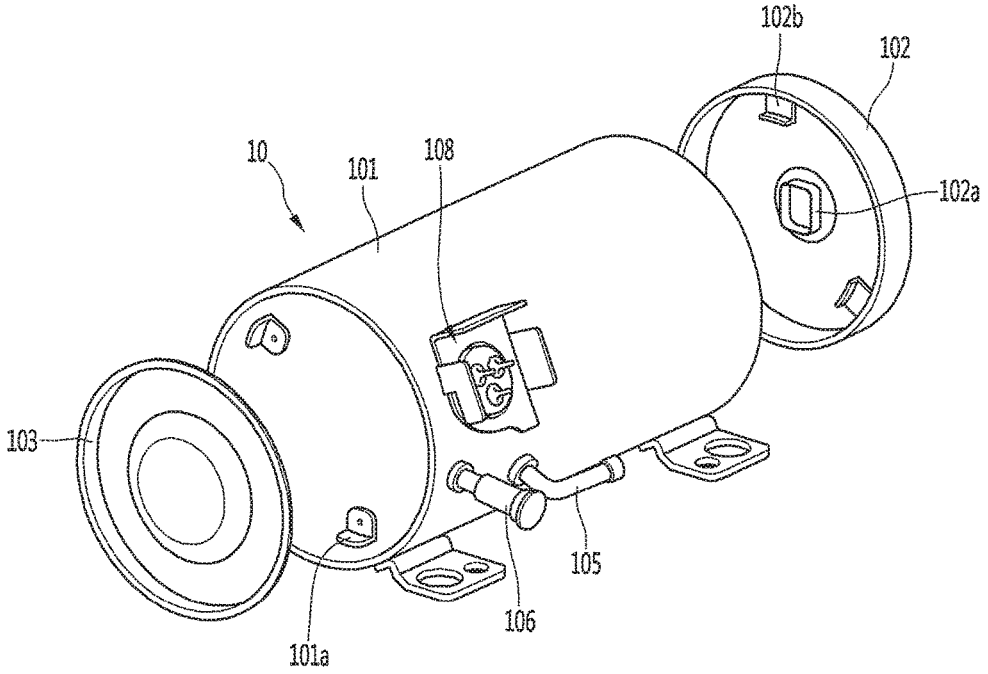
FIG. 2 is an exploded perspective view of a shell and a shell cover of the linear compressor according to an embodiment.

FIG. 1 is a perspective view illustrating an outer appearance of a linear compressor according to an embodiment. FIG. 2 is an exploded perspective view illustrating a shell and a shell cover of the linear compressor according to an embodiment.

Referring to FIGS. 1 and 2, a linear compressor 10 according to an embodiment may include a shell 101 and shell covers 102 and 103 coupled to the shell 101. Each of the first and second shell covers 102 and 103 may be understood as one component of the shell 101.

A leg 50 may be coupled to a lower portion of the shell 101. The leg 50 may be coupled to a base of a product in which the linear compressor 10 is installed or provided. For example, the product may include a refrigerator, and the base may include a machine room base of the refrigerator. For another example, the product may include an outdoor unit of an air conditioner, and the base may include a base of the outdoor unit.

The shell 101 may have an approximately cylindrical shape and be disposed to lie in a horizontal direction or an axial direction. In FIG. 1, the shell 101 may extend in the horizontal direction and have a relatively low height in a radial direction. That is, as the linear compressor 10 has a low height, when the linear compressor 10 is installed or provided in the machine room base of the refrigerator, a machine room may be reduced in height.

A terminal 108 may be installed or provided on an outer surface of the shell 101. The terminal 108 may be understood as a component for transmitting external power to a motor assembly (see reference numeral 140 of FIG. 3) of the linear compressor 10. The terminal 108 may be connected to a lead line of a coil (see reference numeral 141*c* of FIG. 3).

A bracket 109 may be installed or provided outside of the terminal 108. The bracket 109 may include a plurality of brackets that surrounds the terminal 108, The bracket 109 may protect the terminal 108 against an external impact.

Both sides of the shell 101 may be open. The shell covers 102 and 103 may be coupled to both open sides of the shell 101. The shell covers 102 and 103 may include a first shell cover 102 coupled to one open side of the shell 101 and a second shell cover 103 coupled to the other open side of the shell 101. An inner space of the shell 101 may be sealed by the shell covers 102 and 103.

In FIG. 1, the first shell cover 102 may be disposed at a first or right portion of the linear compressor 10, and the second shell cover 103 may be disposed at a second or left portion of the linear compressor 10. That is, the first and second shell covers 102 and 103 may be disposed to face each other.

The linear compressor 10 further includes a plurality of pipes 104, 105, and 106 provided in the shell 101 or the shell covers 102 and 103 to suction, discharge, or inject the refrigerant. The plurality of pipes 104, 105, and 106 may include a suction pipe 104 through which the refrigerant may be suctioned into the linear compressor 10, a discharge pipe 105 through which the compressed refrigerant may be discharged from the linear compressor 10, and a process pipe through which the refrigerant may be supplemented to the linear compressor 10.

For example, the suction pipe 104 may be coupled to the first shell cover 102. The refrigerant may be suctioned into the linear compressor 10 through the suction pipe 104 in an axial direction.

The discharge pipe 105 may be coupled to an outer circumferential surface of the shell 101. The refrigerant suctioned through the suction pipe 104 may flow in the axial direction and then be compressed. Also, the compressed refrigerant may be discharged through the discharge pipe 105. The discharge pipe 105 may be disposed at a position which is adjacent to the second shell cover 103 rather than the first shell cover 102.

The process pipe 106 may be coupled to the outer circumferential surface of the shell 101. A worker may inject the refrigerant into the linear compressor 10 through the process pipe 106.

The process pipe 106 may be coupled to the shell 101 at a height different from a height of the discharge pipe 105 to avoid interference with the discharge pipe 105. The height may be understood as a distance from the leg 50 in the vertical direction (or the radial direction). As the discharge pipe 105 and the process pipe 106 are coupled to the outer circumferential surface of the shell 101 at the heights different from each other, a worker's work convenience may be improved.

At least a portion of the second shell cover 103 may be disposed adjacent to an inner circumferential surface of the shell 101, which corresponds to a point to which the process pipe 106 may be coupled. That is, at least a portion of the second shell cover 103 may act as a flow resistance to the refrigerant injected through the process pipe 106.

Thus, in view of the passage of the refrigerant, the passage of the refrigerant introduced through the process pipe 106 may have a size that gradually decreases toward the inner space of the shell 101. In this process, a pressure of the refrigerant may be reduced to allow the refrigerant to be vaporized. Also, in this process, oil contained in the refrigerant may be separated. Thus, the refrigerant from which the oil is separated may be introduced into a piston 130 to improve compression performance of the refrigerant. The oil may be understood as a working oil existing in a cooling system.

A cover support part or support 102*a* may be disposed or provided on an inner surface of the first shell cover 102. A second support device or support 185, which will be described hereinafter, may be coupled to the cover support part 102*a*. The cover support part 102*a* and the second support device 185 may be understood as devices that support a main body of the linear compressor 10. The main body of the compressor may represent a part or portion provided in the shell 101. For example, the main body may include a drive part or drive that reciprocates forward and backward and a support part or support that supports the drive part. The drive part may include parts or components, such as the piston 130, a magnet frame 138, a permanent magnet 146, a support 137, and a suction muffler 150. Also, the support part may include parts or components, such as resonant springs 176*a* and 176*b*, a rear cover 170, a stator cover 149, a first support device or support 165, and a second support device or support 185.

A stopper 102*b* may be disposed or provided on the inner surface of the first shell cover 102. The stopper 102*b* may be understood as a component that prevents the main body of the compressor, particularly, the motor assembly 140 from being bumped by the shell 101 and thus damaged due to vibration or an impact occurring during transportation of the linear compressor 10. The stopper 102*b* may be disposed or provided adjacent to the rear cover 170, which will be described hereinafter. Thus, when the linear compressor 10 is shaken, the rear cover 170 may interfere with the stopper 102*b* to prevent the impact from being transmitted to the motor assembly 140.

A spring coupling part or portion 101*a* may be disposed or provided on the inner surface of the shell 101. For example, the spring coupling part 101*a* may be disposed at a position which is adjacent to the second shell cover 103. The spring coupling part 101*a* may be coupled to a first support spring 166 of the first support device 165, which will be described hereinafter. As the spring coupling part 101*a* and the first support device 165 are coupled to each other, the main body of the compressor may be stably supported inside of the shell 101.

Figure 3:
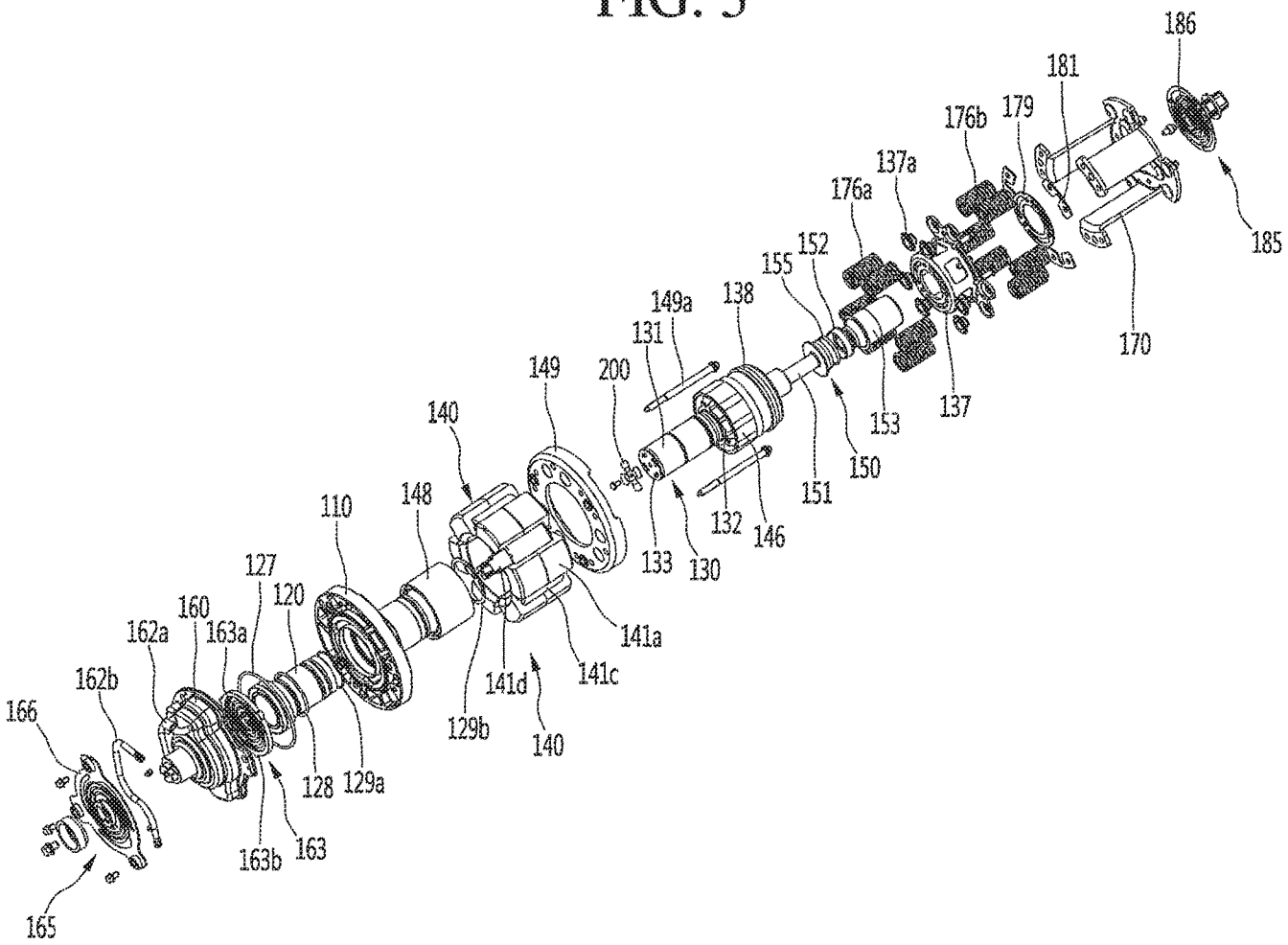
FIG. 3 is an exploded perspective view illustrating internal parts or components of the linear compressor according to an embodiment.
Figure 4:
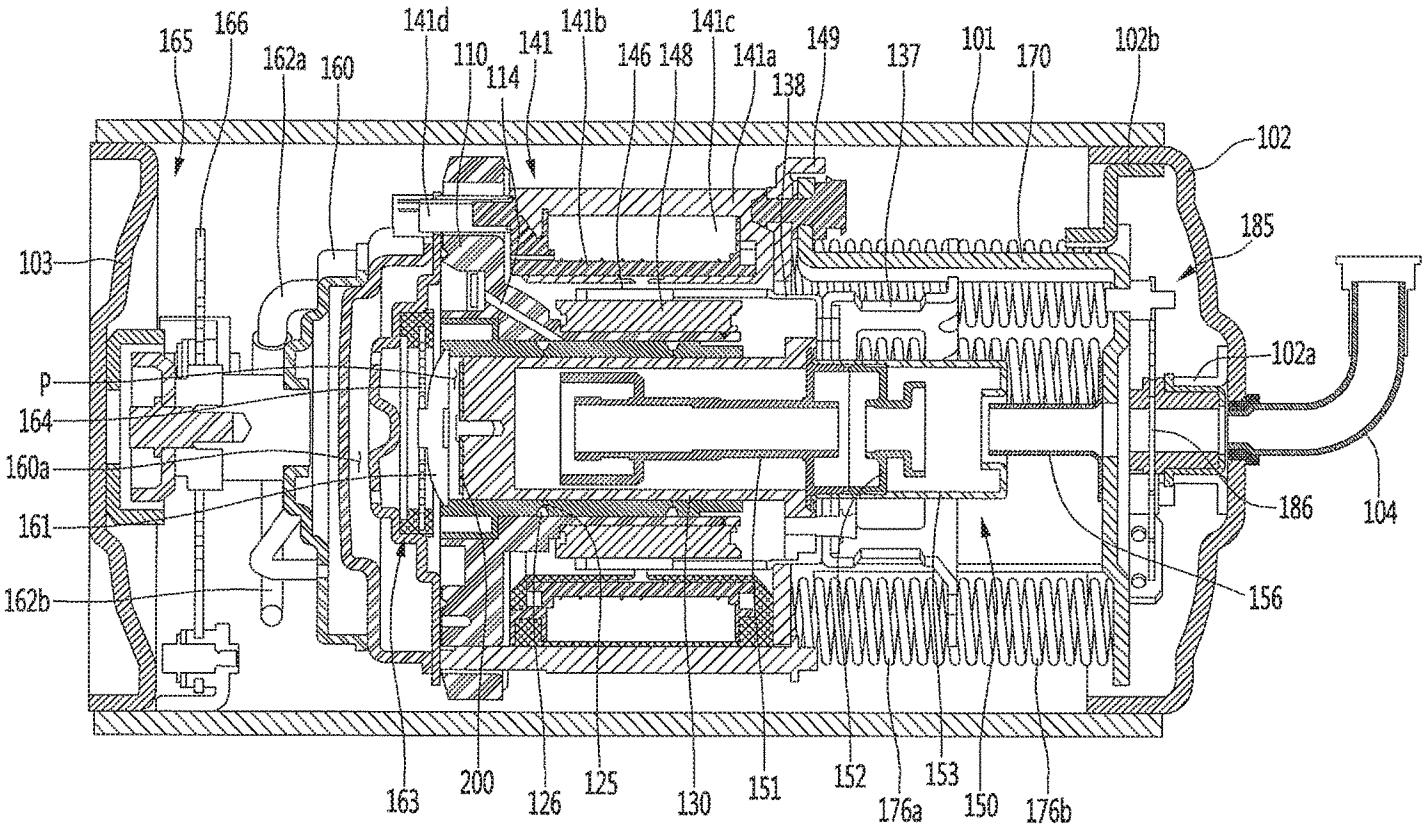
FIG. 4 is a cross-sectional view taken along line IV-IV' of FIG. 1.

FIG. 3 is an exploded perspective view illustrating internal components of the linear compressor according to an embodiment. FIG. 4 is a cross-sectional view illustrating internal components of the linear compressor according to an embodiment.

Referring to FIGS. 3 and 4, the linear compressor 10 according to an embodiment may include a cylinder 120 provided in the shell 101, the piston 130, which linearly reciprocates within the cylinder 120, and the motor assembly 140, which functions as a linear motor to apply drive force to the piston 130. When the motor assembly 140 is driven, the piston 130 may linearly reciprocate in the axial direction.

The linear compressor 10 may further include a suction muffler 150 coupled to the piston 130 to reduce noise generated from the refrigerant suctioned through the suction pipe 104. The refrigerant suctioned through the suction pipe 104 may flow into the piston 130 via the suction muffler 150. For example, while the refrigerant passes through the suction muffler 150, the flow noise of the refrigerant may be reduced.

The suction muffler 150 may include a plurality of mufflers 151 152, and 153. The plurality of mufflers 151, 152, and 153 may include a first muffler 151, a second muffler 152, and a third muffler 153, which may be coupled to each other.

The first muffler 151 may be disposed or provided within the piston 130, and the second muffler 152 may be coupled to a rear portion of the first muffler 151. Also, the third muffler 153 may accommodate the second muffler 152 therein and extend to a rear side of the first muffler 151. In view of a flow direction of the refrigerant, the refrigerant suctioned through the suction pipe 104 may successively pass through the third muffler 153, the second muffler 152, and the first muffler 151. In this process, the flow noise of the refrigerant may be reduced.

The suction muffler 150 may further include a muffler filter 155. The muffler filter 155 may be disposed on or at an interface on or at which the first muffler 151 and the second muffler 152 are coupled to each other. For example, the muffler filter 155 may have a circular shape, and an outer circumferential portion of the muffler filter 155 may be supported between the first and second mufflers 151 and 152.

The "axial direction" may be understood as a direction in which the piston 130 reciprocates, that is, a horizontal direction in FIG. 4. Also, "in the axial direction", a direction from the suction pipe 104 toward a compression space P, that is, a direction in which the refrigerant flows may be defined as a "frontward direction", and a direction opposite to the frontward direction may be defined as a "rearward direction". When the piston 130 moves forward, the compression space P may be compressed. On the other hand, the "radial direction" may be understood as a direction which is perpendicular to the direction in which the piston 130 reciprocates, that is, a vertical direction in FIG. 4.

The piston 130 may include a piston body 131 having an approximately cylindrical shape and a piston flange part or flange 132 that extends from the piston body 131 in the radial direction. The piston body 131 may reciprocate inside of the cylinder 120, and the piston flange part 132 may reciprocate outside of the cylinder 120.

The cylinder 120 may be configured to accommodate at least a portion of the first muffler 151 and at least a portion of the piston body 131. The cylinder 120 may have the compression space P in which the refrigerant may be compressed by the piston 130. Also, a suction hole 133, through which the refrigerant may be introduced into the compression space P, may be defined in a front portion of the piston body 131, and a suction valve 200 that selectively opens the suction hole 133 may be disposed or provided on a front side of the suction hole 133. A coupling hole, to which a predetermined coupling member 135*a* may be coupled, may be defined in an approximately central portion of the suction valve 200.

A discharge cover 160 that defines a discharge space 160*a* for the refrigerant discharged from the compression space P and a discharge valve assembly 161 and 163 coupled to the discharge cover 160 to selectively discharge the refrigerant compressed in the compression space P may be provided at a front side of the compression space P. The discharge space 160*a* may include a plurality of space parts or spaces partitioned by inner walls of the discharge cover 160. The plurality of space parts or spaces disposed or provided in the front and rear direction to communicate with each other.

The discharge valve assembly 161 and 163 may include a discharge valve 161 which may be opened when the pressure of the compression space P is above a discharge pressure to introduce the refrigerant into the discharge space 160*a* and a spring assembly 163 disposed or provided between the discharge valve 161 and the discharge cover 160 to provide elastic force in the axial direction. The spring assembly 163 may include a valve spring 163*a* and a spring support part or support 163*b* that supports the valve spring 163*a* to the discharge cover 160. For example, the valve spring 163*a* may include a plate spring. The spring support part 163*b* may be integrally injection-molded to the valve spring 163*a* through an injection-molding process, for example.

The discharge valve 161 may be coupled to the valve spring 163*a*, and a rear portion or rear surface of the discharge valve 161 may be disposed to be supported on a front surface of the cylinder 120. When the discharge valve 161 is supported on the front surface of the cylinder 120, the compression space may be maintained in the sealed state. When the discharge valve 161 is spaced apart from the front surface of the cylinder 120, the compression space P may be opened to allow the refrigerant in the compression space P to be discharged.

The compression space P may be understood as a space defined between the suction valve 200 and the discharge valve 161. Also, the suction valve 200 may be disposed on or at one side of the compression space P, and the discharge valve 161 may be disposed on or at the other side of the compression space P, that is, an opposite side of the suction valve 200.

While the piston 130 linearly reciprocates within the cylinder 120, when the pressure of the compression space P is below the discharge pressure and a suction pressure, the suction valve 200 may be opened to suction the refrigerant into the compression space P. On the other hand, when the pressure of the compression space P is above the suction pressure, the suction valve 200 may compress the refrigerant of the compression space P in a state in which the suction valve 200 is closed.

When the pressure of the compression space P is above the discharge pressure, the valve spring 163*a* may be deformed forward to open the discharge valve 161. Here, the refrigerant may be discharged from the compression space P into the discharge space 160*a* of the discharge cover 160. When the discharge of the refrigerant is completed, the valve spring 163*a* may provide restoring force to the discharge valve 161 to close the discharge valve 161.

The linear compressor 10 may further include a cover pipe 162*a* coupled to the discharge cover 160 to discharge the refrigerant flowing through the discharge space 160*a* of the discharge cover 160. For example, the cover pipe 162*a* may be made of a metal material.

The linear compressor 10 may further include a loop pipe 162*b* coupled to the cover pipe 162*a* to transfer the refrigerant flowing through the cover pipe 162*a* to the discharge pipe 105. The loop pipe 162*b* may have one or a first side coupled to the cover pipe 162*a* and the other or a second side coupled to the discharge pipe 105.

The loop pipe 162*b* may be made of a flexible material and have a relatively long length. Also, the loop pipe 162*b* may roundly extend from the cover pipe 162*a* along the inner circumferential surface of the shell 101 and be coupled to the discharge pipe 105. For example, the loop pipe 162*b* may have a wound shape.

The linear compressor 10 further includes a frame 110. The frame 110 is understood as a component for fixing the cylinder 120. For example, the cylinder 120 may be press-fitted into the frame 110. Each of the cylinder 120 and the frame 110 may be made of aluminum or an aluminum alloy material, for example.

The frame 110 may be disposed or provided to surround the cylinder 120. That is, the cylinder 120 may be disposed or provided to be accommodated into the frame 110. Also, the discharge cover 200 may be coupled to a front surface of the frame 110 using a coupling member.

The motor assembly 140 may include an outer stator 141 fixed to the frame 110 and disposed or provided to surround the cylinder 120, an inner stator 148 disposed or provided to be spaced inward from the outer stator 141, and the permanent magnet 146 disposed or provided in a space between the outer stator 141 and the inner stator 148.

The permanent magnet 146 may be linearly reciprocated by mutual electromagnetic force between the outer stator 141 and the inner stator 148. Also, the permanent magnet 146 may be provided as a single magnet having one polarity or by coupling a plurality of magnets having three polarities to each other.

The magnet frame 138 may be installed or provided on the permanent magnet 146. The magnet frame 138 may have an approximately cylindrical shape and be disposed or provided to be inserted into the space between the outer stator 141 and the inner stator 148.

Referring to the cross-sectional view of FIG. 4, the magnet frame 138 may be coupled to the piston flange part 132 to extend in an outer radial direction and then be bent forward. The permanent magnet 146 may be installed or provided on a front portion of the magnet frame 138. When the permanent magnet 146 reciprocates, the piston 130 may reciprocate together with the permanent magnet 146 in the axial direction.

The outer stator 141 may include coil winding bodies 141*b*, 141*c*, and 141*d* and a stator core 141*a*. The coil winding bodies 141*b*, 141*c*, and 141*d* may include a bobbin 141*b* and a coil 141*c* wound in a circumferential direction of the bobbin 141*b*. The coil winding bodies 141*b*, 141*c*, and 141*d* may further include a terminal part or portion 141*d* that guides a power line connected to the coil 141*c* so that the power line is led out or exposed to the outside of the outer stator 141. The terminal part 141*d* may be disposed to be inserted into a terminal insertion part or portion of the frame 110.

The stator core 141*a* may include a plurality of core blocks in which a plurality of laminations are laminated in a circumferential direction. The plurality of core blocks may be disposed or provided to surround at least a portion of the coil winding bodies 141*b* and 141*c*.

A stator cover 149 may be disposed or provided on one or a first side of the outer stator 141. That is, the outer stator 141 may have one or a first side supported by the frame 110 and the other or a second side supported by the stator cover 149.

The linear compressor 10 may further include a cover coupling member 149*a* for coupling the stator cover 149 to the frame 110. The cover coupling member 149*a* may pass through the stator cover 149 to extend forward to the frame 110 and then be coupled to a first coupling hole (not shown) of the frame 110.

The inner stator 148 may be fixed to a circumference of the frame 110. Also, in the inner stator 148, the plurality of laminations may be laminated in the circumferential direction outside of the frame 110.

The linear compressor 10 may further include a support 137 that supports the piston 130. The support 137 may be coupled to a rear portion of the piston 130, and the muffler 150 may be disposed or provided to pass through the inside of the support 137. The piston flange part 132, the magnet frame 138, and the support 137 may be coupled to each other using a coupling member.

A balance weight 179 may be coupled to the support 137. A weight of the balance weight 179 may be determined based on a drive frequency range of the compressor body.

The linear compressor 10 may further include a rear cover 170 coupled to the stator cover 149 to extend backward and supported by the second support device 185. The rear cover 170 may include three support legs, and the three support legs may be coupled to a rear surface of the stator cover 149. A spacer 181 may be disposed or provided between the three support legs and the rear surface of the stator cover 149. A distance from the stator cover 149 to a rear end of the rear cover 170 may be determined by adjusting a thickness of the spacer 181. Also, the rear cover 170 may be spring-supported by the support 137.

The linear compressor 10 may further include an inflow guide part or guide 156 coupled to the rear cover 170 to guide an inflow of the refrigerant into the muffler 150. At least a portion of the inflow guide part 156 may be inserted into the suction muffler 150.

The linear compressor 10 may further include a plurality of resonant springs 176*a* and 176*b* which may be adjusted in natural frequency to allow the piston 130 to perform a resonant motion. The plurality of resonant springs 176*a* and 176*b* may include a first resonant spring 176*a* supported between the support 137 and the stator cover 149 and a second resonant spring 176*b* supported between the support 137 and the rear cover 170. The drive part that reciprocates within the linear compressor 10 may be stably moved by the action of the plurality of resonant springs 176*a* and 176*b* to reduce vibration or noise due to the movement of the drive part. The support 137 may include a first spring support part or support 137*a* coupled to the first resonant spring 176*a*.

The linear compressor 10 may include the frame 110 and a plurality of sealing members or seals 127, 128, 129*a*, and 129*b* that increases a coupling force between the peripheral parts or components around the frame 110. The plurality of sealing members 127, 128, 129*a*, and 129*b* may include a first sealing member or seal 127 disposed or provided at a portion at which the frame 110 and the discharge cover 160 are coupled to each other. The first sealing member 127 may be disposed or provided on or in a second installation groove (see reference numeral 116*b* of FIG. 6) of the frame 110.

The plurality of sealing members 127, 128, 129*a*, and 129*b* may further include a second sealing member or seal 128 disposed or provided at a portion at which the frame 110 and the cylinder 120 are coupled to each other. The second sealing member 128 may be disposed on or in a first installation groove of the frame 110.

The plurality of sealing members 127, 128, 129*a*, and 129*b* may further include a third sealing member or seal 129*a* disposed or provided between the cylinder 120 and the frame 110. The third sealing member 129*a* may be disposed on or in a cylinder groove defined in the rear portion of the cylinder 120. The third sealing member 129*a* may prevent a leakage of a refrigerant of a gas pocket defined between the inner circumferential surface of the frame 110 and an outer circumferential surface of the cylinder 120 and may increase coupling force of the frame 110 and the cylinder 120.

The plurality of sealing members 127, 128, 129*a*, and 129*b* further include a fourth sealing member or seal 129*b* disposed or provided at a portion at which the frame 110 and the inner stator 148 are coupled to each other. The fourth sealing member 129*b* may be disposed or provided on or in a third installation groove of the frame 110.

Each of the first to fourth sealing members 127, 128, 129*a*, and 129*b* may have a ring shape.

The linear compressor 10 further includes a first support device or support 165 coupled to the discharge cover 160 to support one or a first side of the main body of the linear compressor 10. The first support device 165 may be disposed or provided adjacent to the second shell cover 103 to elastically support the main body of the linear compressor 10. The first support device 165 may include a first support spring 166. The first support spring 166 may be coupled to the spring coupling part 101*a*.

The linear compressor 10 may further include a second support device or support 185 coupled to the rear cover 170 to support the other side of the main body of the linear compressor 10. The second support device 185 may be coupled to the first shell cover 102 to elastically support the main body of the linear compressor 10. The second support device 185 may include a second support spring 186. The second support spring 186 may be coupled to the cover support part 102*a*.

Figure 5:
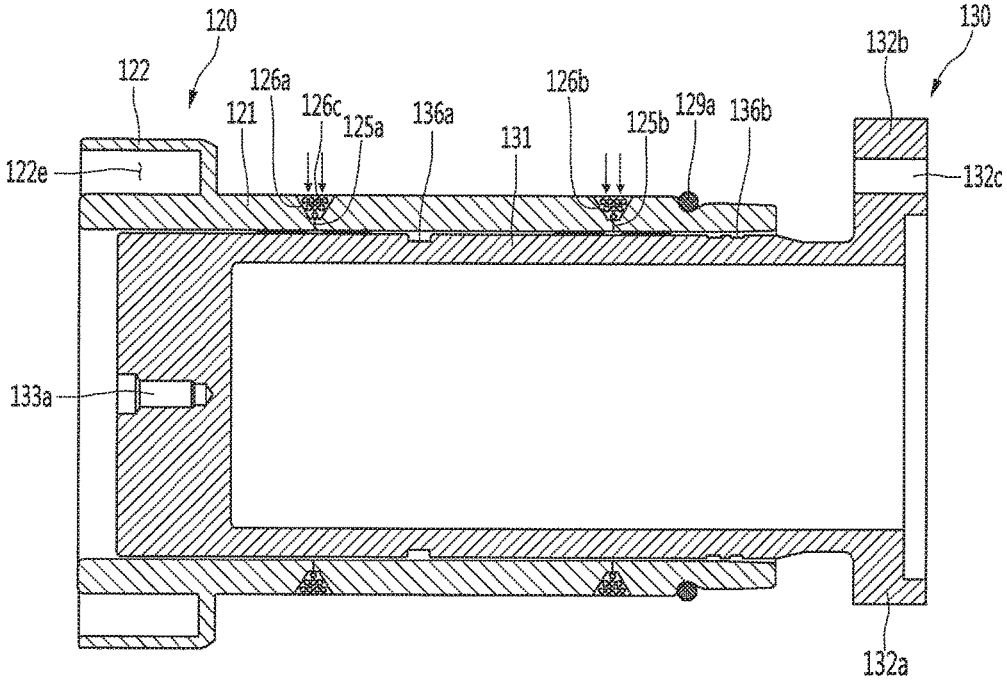
FIG. 5 is a cross-sectional view of a state in which a piston is inserted into the cylinder according to an embodiment.

FIG. 5 is a cross-sectional view illustrating a state in which a piston is inserted into a cylinder according to an embodiment. Referring to FIG. 5, the cylinder 120 according to an embodiment may include a cylinder body 121 that extends in the axial direction and a cylinder flange 122 disposed or provided outside of a front portion of the cylinder body 121. The cylinder body 121 may have a cylindrical shape with a central axis in the axial direction and be inserted into the frame 110. Thus, an outer circumferential surface of the cylinder body 121 may be disposed or provided to face an inner circumferential surface of the frame 110.

The cylinder body 121 may define a gas inflow part or inflow 126 through which at least a portion of the refrigerant discharged through the discharge valve 161 may be introduced. At least a portion of the refrigerant may be understood as a refrigerant used as a gas bearing between the piston 130 and the cylinder 120.

The refrigerant used as the gas bearing may pass through the gas hole 114 defined in the frame 110 and flow into a gas pocket defined between the inner circumferential surface of the frame 110 and the outer circumferential surface of the cylinder 120. The refrigerant of the gas pocket may flow into the gas inflow part 126.

The gas inflow part 126 may be recessed inward from the outer circumferential surface of the cylinder body 121 in the radial direction. Also, the gas inflow part 126 may have a circular shape along the outer circumferential surface of the cylinder body 121 with respect to the central axis in the axial direction.

A plurality of the gas inflow part 126 may be provided. For example, two gas inflow parts 126 may be provided. A first gas inflow part or inflow 126*a* of the two gas inflow parts 126 may be disposed on a front portion of the cylinder body 121, that is, at a position which is close to the discharge valve 161, and a second gas inflow part or inflow 126*b* may be disposed or provided on a rear portion of the cylinder body 121, that is, at a position which is close to a compressor suction side of the refrigerant. That is, the first gas inflow part 126*a* may be disposed or provided at a front side with respect to a central portion in a frontward and rearward direction of the cylinder body 121, and the second gas inflow part 126*b* may be disposed at a rear side.

A cylinder filter member or filter 126*c* may be installed or provided on or in the first and second gas inflow parts 126*a* and 126*b*. The cylinder filter member 126*c* may prevent a foreign substance having a predetermined size or more from being introduced into the cylinder 120 and perform a function of adsorbing oil contained in the refrigerant. The predetermined size may be about 1 μm.

The cylinder filter member 126*c* may include a thread which is wound around the gas inflow part 126. The thread may be made of a polyethylene terephthalate (PET) material and have a predetermined thickness or diameter.

The cylinder body 121 may further include a cylinder nozzle 125 that extends inward from the gas inflow part 126 in the radial direction. The cylinder nozzle 125 may extend up to the inner circumferential surface of the cylinder body 121. The cylinder nozzle 125 may include a first nozzle part or nozzle 125*a* that extends from the first gas inflow part 126*a* to the inner circumferential surface of the cylinder body 121 and a second nozzle part or nozzle 125*b* that extends from the second gas inflow part 126*b* to the inner circumferential surface of the cylinder body 121.

The refrigerant which is filtered by the cylinder filter member 126*c* while passing through the first gas inflow part 126*a* may be introduced into a space between the inner circumferential surface of the first cylinder body 121 and the outer circumferential surface of the piston body 131 through the first nozzle part 125*a*. The refrigerant which is filtered by the cylinder filter member 126*c* while passing through the second gas inflow part 126*b* may be introduced into a space between the inner circumferential surface of the first cylinder body 121 and the outer circumferential surface of the piston body 131 through the second nozzle part 125*b*.

The gas refrigerant flowing to the outer circumferential surface of the piston body 131 through the first and second nozzle parts 125*a* and 125*b* may provide a lifting force to the piston 130 to perform a function as the gas bearing with respect to the piston 130.

The cylinder flange 122 may include a first flange that extends outward from the cylinder body 121 in the radial direction and a second flange that extends forward from the first flange. The cylinder body 121 and the cylinder flanges 122 may define a deformable space part or space 122*e* which is deformable when the cylinder 120 is press-fitted into the frame 110.

Figure 6:
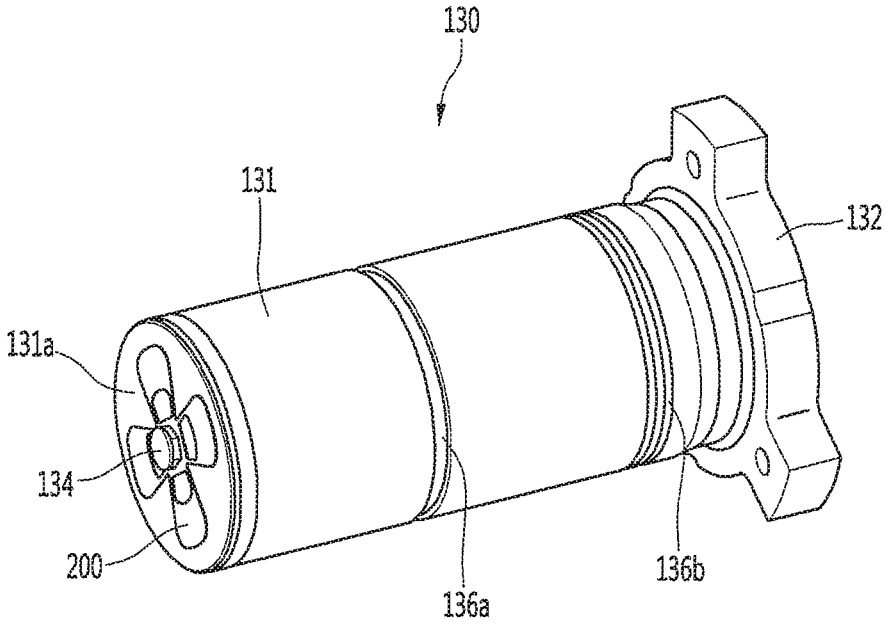
FIG. 6 is a perspective view illustrating a piston assembly according to an embodiment.
Figure 7:
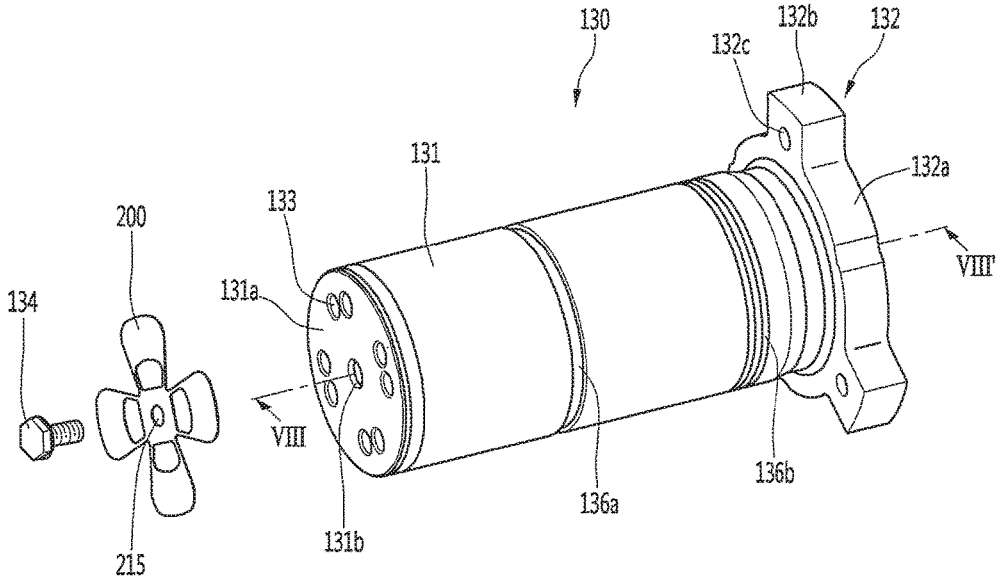
FIG. 7 is an exploded perspective view illustrating a piston assembly according to an embodiment.
Figure 8:
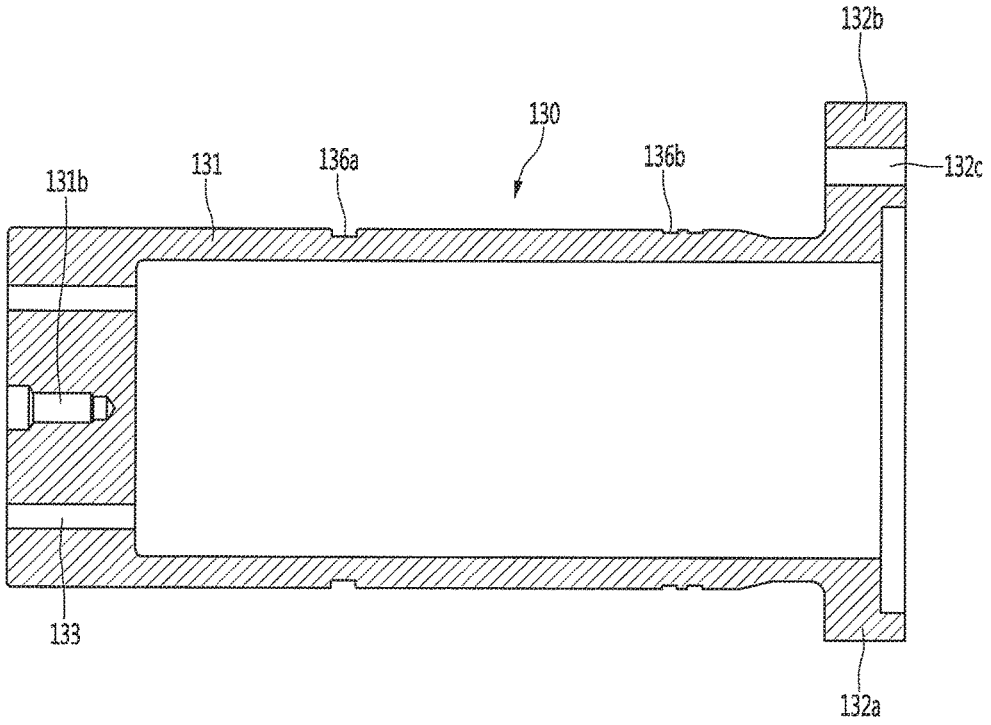
FIG. 8 is a cross-sectional view, taken along line VIII-VIII' of FIG. 7.
Figure 9:
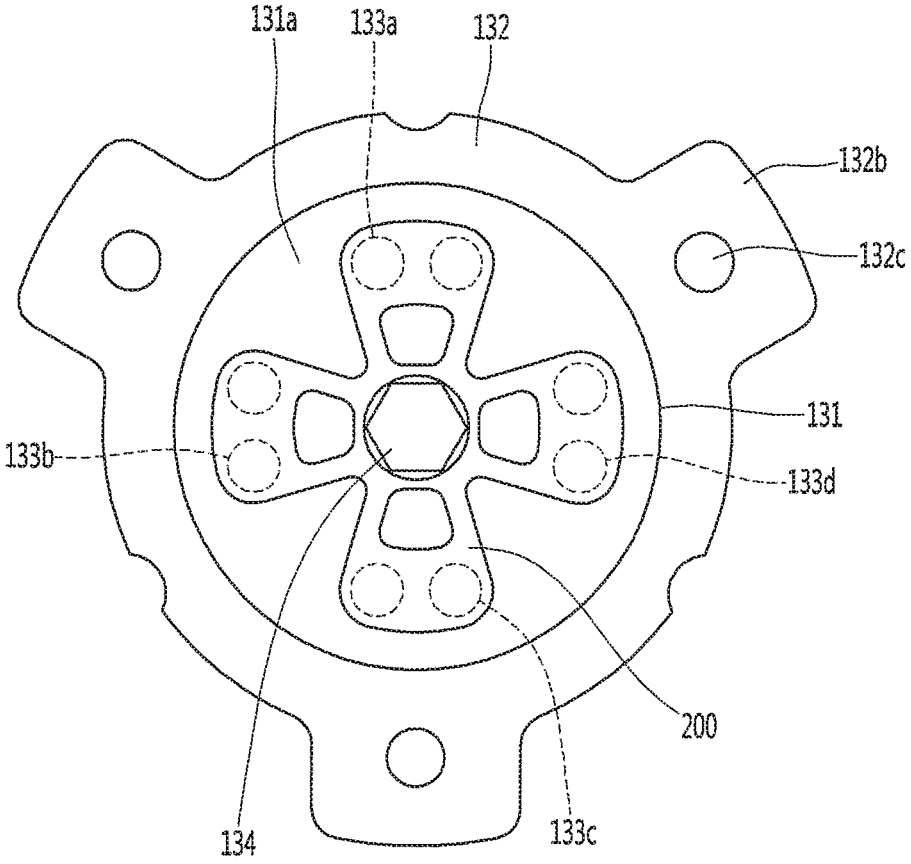
FIG. 9 is a front view illustrating a piston assembly according to an embodiment.

FIG. 6 is a perspective view illustrating a piston assembly according to an embodiment. FIG. 7 is an exploded perspective view illustrating of a piston assembly according to an embodiment. FIG. 8 is a cross-sectional view, taken along line VIII-VIII' of FIG. 7. FIG. 9 is a front view illustrating a piston assembly according to an embodiment.

Referring to FIGS. 6 to 9, a linear compressor 10 according to an embodiment includes a piston assembly 130 and 200 reciprocating in the axial direction, that is, the frontward and rearward direction within the cylinder 120. The piston assembly 130 and 200 may include the piston 130 and the suction valve 200 coupled to a front side of the piston 130.

The linear compressor 10 may further include a valve coupling member 134 that couples the suction valve 200 to a coupling hole 131*b* of the piston 130. The coupling hole 131*b* may be defined in an approximately central portion of a front end surface of the piston 130. The valve coupling member 134 may pass through a valve coupling hole 215 of the suction valve 200 and be coupled to the coupling hole 131*b*.

The piston 130 may include a piston body 131 having an approximately cylindrical shape and extending in the frontward and rearward direction and a piston flange 132 that extends outward from the piston body 131 in the radial direction. The front portion of the piston body 131 may include a main body front end 131*a* in which the coupling hole 131*b* may be defined. A suction hole 133 which may be selectively covered by the suction valve 200 may be defined in the main body front end 131*a*. The suction hole 133 may be provided, and the plurality of suction holes 133 may be defined outside of the coupling hole 131*b*. The plurality of suction holes 133 may be defined to surround the coupling hole 131*b*.

For example, the plurality of suction holes 133 may include eight suction holes. The eight suction holes may include two first suction holes 133*a* defined in an upper portion of the main body front end 131*a*, two second suction holes 133*b* defined on a left or first portion of the main body front end 131*a*, two third suction holes 133*c* defined in a lower portion of the main body front end 131*a*, and two fourth suction holes 133*d* defined in a right or second portion of the main body front end 131*a*.

The first to fourth suction holes 133*a*, 133*b*, 133*c*, and 133*d* may be defined at positions corresponding to a plurality of wing parts or wings 220 of the suction valve 200, which will be described hereinafter, in particular, a cover part or cover 235. Each of the suction holes may be selectively opened and closed by one wing part. For example, the plurality of wing parts 220 may include four wing parts.

A rear portion of the piston body 131 may be opened to suction the refrigerant. At least a portion of the suction muffler 150, that is, the first muffler 151 may be inserted into the piston body 131 through the opened rear portion of the piston body 131.

A first piston groove 136*a* may be defined on the outer circumferential surface of the piston body 131. The first piston groove 136*a* may be defined on a front side with respect to a central line in the radial direction of the piston body 131. The first piston groove 136*a* may be understood as a component that guides a smooth flow of the refrigerant gas introduced through the cylinder nozzle 125 and prevents a pressure loss from occurring.

A second piston groove 136*b* may be defined on the outer circumferential surface of the piston body 131. The second piston groove 136*b* may be defined on a rear side with respect to the central line in the radial direction of the piston body 131. The second piston groove 136*b* may be understood as a "discharge guide groove" that guides the discharge of the refrigerant gas used for lifting the piston 130 to the outside of the cylinder 120. As the refrigerant gas is discharged to the outside of the cylinder 120 through the second piston groove 136*b*, the refrigerant gas used as the gas bearing may be prevented from being introduced again into the compression space P via the front side of the piston body 131.

The piston flange 132 may include a flange body 132*a* that extends outward from the rear portion of the piston body 131 in the radial direction and a piston coupling part or portion 132*b* that further extends outward from the flange body 132*a* in the radial direction. The piston coupling part 132*b* may include a piston coupling hole 132*c* to which a predetermined coupling member may be coupled. The coupling member may pass through the piston coupling hole 132*c* and be coupled to the magnet frame 138 and the support 137. A plurality of the piston coupling part 132*b* may be provided, and the plurality of piston coupling parts 132*b* may be spaced apart from each other and disposed or provided on an outer circumferential surface of the flange body 132*a*. The second piston groove 136*b* may be understood as being disposed or provided between the first piston groove 136*a* and the piston flange 132.

Figure 10:
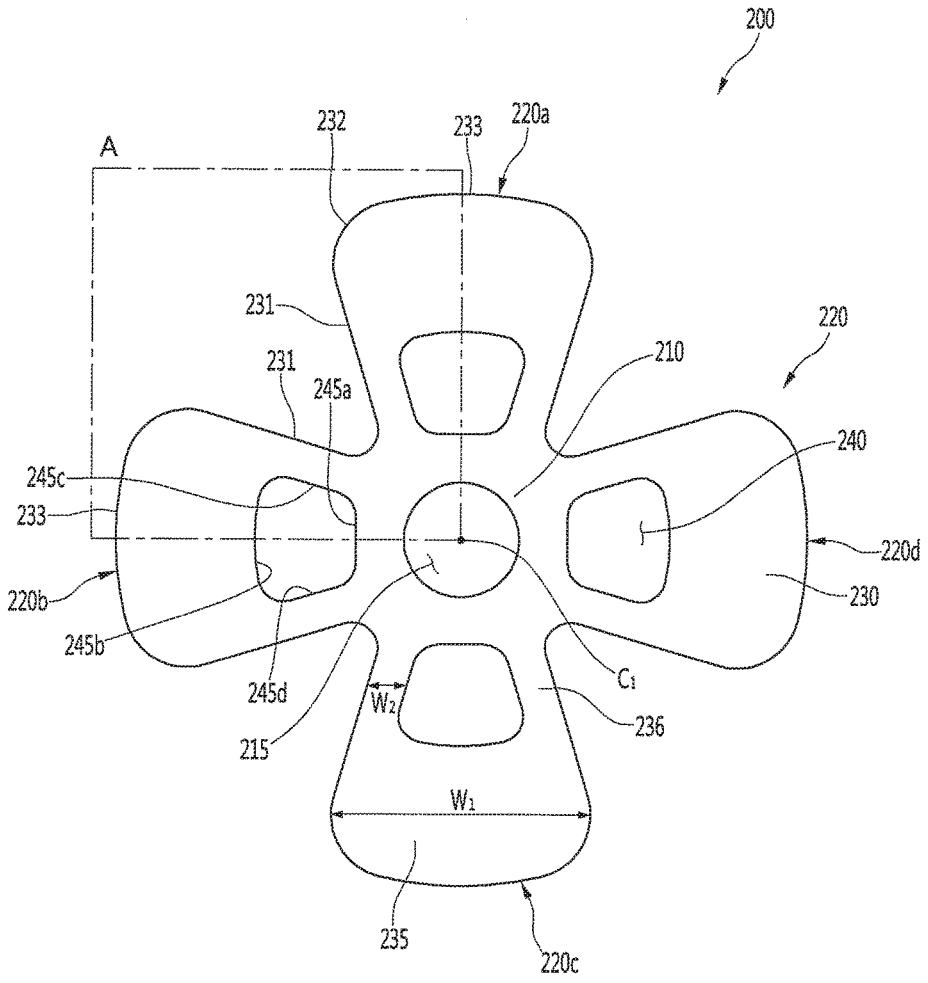
FIG. 10 is a front view illustrating a suction valve according to an embodiment.
Figure 11:
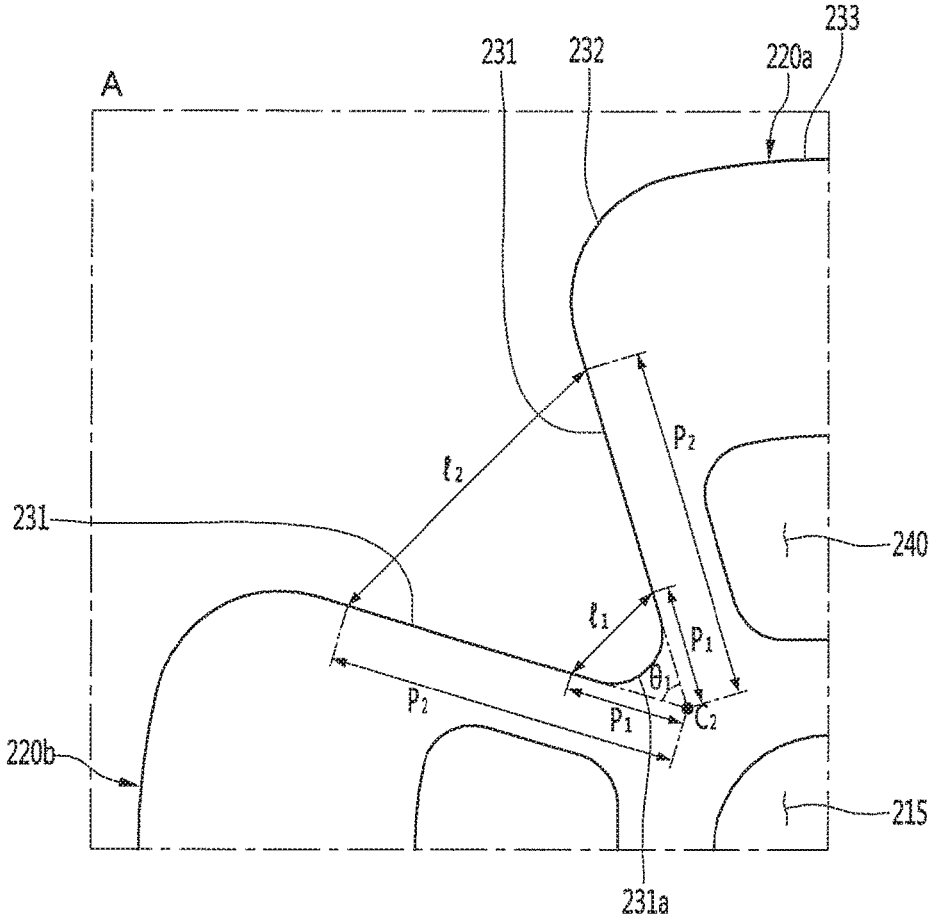
FIG. 11 is an enlarged view illustrating a portion A of FIG. 10.

FIG. 10 is a front view illustrating a suction valve according to an embodiment. FIG. 11 is an enlarged view illustrating a portion A of FIG. 10.

Referring to FIG. 10, suction valve 200 according to an embodiment may include a fixing part or portion 210 with a valve coupling hole 215 to which the valve coupling member 134 may be coupled, and a plurality of the wing parts 220 that extends outward from the fixing part 210. The fixing part 210 and the plurality of wing parts 220 may be integrally formed.

The valve coupling hole 215 may be defined in a central portion of the fixing part 210 and may have, for example, a circular shape. The suction valve 200 may have a symmetrical shape with respect to a horizontal central line of the suction valve 200 passing through a center C1 of the valve coupling hole 215. Also, the suction valve 200 may have a symmetrical shape with respect to a vertical central line of the suction valve 200 passing through the center C1 of the valve coupling hole 215. The center C1 of the valve coupling hole 215 may be defined in the center of the suction valve 200.

For example, the plurality of wing parts 220 may include four wing parts. The four wing parts may include a first wing part or wing 220*a* provided in an upper portion of the fixing part 210, a second wing part or wing 220*b* provided in a left or first side of the fixing part 210, a third wing part or wing 220*c* provided in a lower portion of the fixing part 210, and a fourth wing part or wing 220*d* provided in a right or second portion of the fixing part 210. As the first to fourth wing parts may be identical to one another, a description of one wing part may be equally applied to the other wing parts.

The first to fourth wing parts 220*a*, 220*b*, 220*c*, and 220*d* may be disposed to open and close the first to fourth suction holes 133*a*, 133*b*, 133*c*, and 133*d*, respectively. The wing part 220 may include a wing body 230 having a flow hole 240. The wing body 230 may be understood as a "valve port" capable of opening or closing the suction hole 133 of the piston 130.

The wing body 230 may include two coupling parts or portions 236 that extend outward from the fixing part 210 in an outside or outer direction of the suction valve 200, and cover part or cover 235 coupled to the two coupling parts 236 to open or close the suction hole 133.

When the cover part 235 opens the suction hole 133, the two coupling parts 236 and the cover part 235 move far away from the main body front end 131*a* of the piston 130. On the other hand, when the cover part 235 closes the suction hole 133, the two coupling parts 236 and the cover part 235 move toward the main body front end 131*a* of the piston 130. A rapidity degree of the movement of the cover part 235 may be referred to as "response performance of the suction valve", a magnitude of the movement may be referred to as an "opened amount of the suction valve", and a number of times of movements to open the suction hole 133 may be referred to as the "number of openings of the suction valve".

When the linear compressor 10 operates at a high drive frequency, the number of openings of the suction valve 200 increases and the opened amount may relatively decrease. That is, as a natural frequency of the linear compressor 10 increases, the response performance of the suction valve 200 may become faster.

The natural frequency of the suction valve 200 may be expressed by the following equation:

$$f_s = \frac{1}{2\pi}\sqrt{\frac{k}{m}}$$

When the driving frequency of the linear compressor increases, the natural frequency of the suction valve needs to increase accordingly. For example, the drive frequency of the linear compressor according to this embodiment may be in a range of 80 Hz to 110 Hz, which is higher than an existing drive frequency (60 Hz) by about 30% to about 80%.

When the natural frequency of the suction valve needs to increase, m needs to decrease and k needs to increase in the above mathematical expression. When m and k in the mathematical expression match the suction valve according to the embodiment, m and k may be understood as a mass of the suction valve and a stiffness of the suction valve, respectively.

In order to increase k, a thickness of the suction valve 200 needs to be increased. If the thickness of the suction valve 200 is too small, the suction valve 200 operating at a high natural frequency may be damaged. If the thickness of the suction valve 200 is too large, the mass of the suction valve 200 increases accordingly and the response performance of the suction valve 200 is reduced.

Therefore, according to this embodiment, the thickness of the suction valve 200 is determined such that the response performance of the suction valve 200 is improved while the damage to the suction valve 200 is prevented. For example, the thickness of the suction valve 200 according to this embodiment may be in a range of about 60 μm to about 80 μm. This thickness of the suction valve 200 is a value reduced by about 40% to about 50% as compared with the thickness (about 80 μm to about 160 μm) of the suction valve provided in the linear compressor operating at 60 Hz.

When the thickness of the suction valve 200 is relatively reduced, the mass of the suction valve 200 is designed to decrease so as to compensate the tendency that the natural frequency of the suction valve is lowered. That is, a shape design has been made for reducing the mass of the suction valve 200 by forming the suction valve 200 to have a relatively small thickness.

The flow hole 240 may be defined between the two coupling parts 236. Due to the formation of the flow hole 240, the mass of the suction valve 200 may be reduced. The flow hole 240 may function to reduce the flow resistance of the refrigerant suctioned through the opened suction hole 133.

A width w2 of the coupling part 236 in one direction may be less than a width w1 of the cover part 235 in one direction. Due to such a form, the two suction holes 133 may be sufficiently covered by the cover part 235 having a relatively large width. Also, as the movement of the coupling part 236 having a relatively small width is easily implemented, the rapid movement of the cover part 235 may be guided.

The wing body 230 may include edge portions 231, 232, and 233 defining an outer surface. The edge portions 231, 232, and 233 may include two first edge portions 231 that extend from the fixing part 210 in the outside direction. The two first edge portions 231 extend radially from two points of the fixing part 210. The two points may be spaced apart from each other.

The two first edge portions 231 may extend to be mutually spread out from the fixing part 210 in the outside direction. The two first edge portions 231 may extend in a straight line.

The edge portions 231, 232, and 233 may include a second edge portion 233 defining an outer circumferential portion of the wing body 230. The edge portions 231, 232, and 233 may include an edge coupling part or portion 232 that couples the first edge portions 231 to the second edge portion 233. The edge coupling part 232 may extend to be rounded from a radial direction of the first edge portions 231 toward a circumferential direction of the second edge portion 233, so as to smoothly connecting the first and second edge portions 231 and 233.

The wing body 230 may include inner circumferential portions 245*a*, 245*b*, 245*c*, and 245*d* defining the flow hole 240. The inner circumferential portions 245*a*,245*b*, 245*c*, and 245*d* may include a first inner circumferential surface 245*a* defining at least a portion of the outer surface of the fixing part 210, and a second inner surface 245*b* defining an inner surface of the cover part 235. The first inner circumferential surface 245*a* and the second inner circumferential surface 245*b* may be disposed at positions facing each other.

The inner circumferential portions 245*a*, 245*b*, 245*c*, and 245*d* may include a third inner circumferential surface 245*c* defining an inner surface of at least one of the two coupling parts 236, and a fourth inner circumferential surface 245*d* defining an inner surface of the other of the two coupling parts. The third inner circumferential surface 245*c* and the fourth inner circumferential surface 245*d* may be disposed at positions facing each other and may have a same length.

The second inner circumferential surface 245*b* and the second edge portion 233 may extend approximately in parallel. The third inner circumferential surface 245*c* and the fourth inner circumferential surface 245*d* may extend in parallel to each of the two first edge portions 231.

Due to such a form, a shape of the outer surface of the wing body 230 and a shape of the flow hole 240, that is, a shape of the inner circumferential portions 245*a*, 245*b*, 245*c*, and 245*c*, correspond each other. For example, the outer surface of the wing body 230 differs from the flow hole 240 only in terms of size, but the shape of the outer surface of the wing part 230 is identical to the shape of the flow hole 240, As a result, as the shape of each wing part 220 of the suction valve 200 and the shape of the flow hole 240 existing in the wing part 220 correspond to each other, it is possible to prevent a stress from being concentrated on a specific point of the suction valve 200 when an impact is transmitted to the suction valve 200 during the process of opening and closing the suction valve 200. If the third inner circumferential surface 245*c* is formed to have a long length and the fourth inner circumferential surface 245*d* is formed to have a short length, or when the third inner circumferential surface 245*c* and one coupling part 236 extend in parallel and the fourth inner circumferential surface 245*d* and the other coupling part 236 extend in nonparallel, a difference in geometric shapes may concentrate a stress on a specific point of the wing part 230, causing damage to the suction valve 200.

Referring to FIG. 11, a space between two adjacent wing parts may be formed to gradually increase toward the outside in the radial direction of the suction valve 200. Hereinafter, the first wing part 220*a* and the second wing part 220*b* disposed on a left or first side of the first wing part 220*a* will be described.

A space spacing the first and second wing parts 220*a* and 220*b* from each other may be defined between the first edge portion 231 provided in the first wing part 220*a* and the first edge portion 231 provided in the second wing part 220*b*. This space may be referred to as a "wing space part" or "wing space". The wing space part may gradually increase toward the outside in the radial direction of the suction valve 200.

A point where an extension line of the first edge portion 231 of the first wing part 220*a* and an extension line of the first edge portion 231 of the second wing part 220*b* meet each other may be defined as an "edge central portion C2". The edge central portion C2 may be formed at one point of the fixing part 210.

An angle between the first edge portion 231 of the first wing part 220*a* and the first edge portion 231 of the second wing part 220*b* may form a preset or predetermined angle θ based on the edge central portion C2. For example, the preset angle θ may be determined within a range of about 30° to about 70°.

Due to such a form, a distance between the first edge portion 231 of the first wing part 220*a* and the first edge portion 231 of the second wing part 220*b* may gradually increase toward the outside of the suction valve 200. That is, a distance between the two first edge portions 231 at a point which is spaced apart from the edge central portion C2 by a first preset or predetermined distance P1 may form a first separation distance l1. Also, a distance between the two first edge portions 231 at a point which is spaced apart from the edge central portion C2 by a second preset or predetermined distance P2 may form a second separation distance l1. The second preset distance P2 may be greater than the first preset distance P1, and the second separation distance l2 may be greater than the first separation distance l1.

As such, as the wing space part, that is, the cut space part, is formed to have a relatively large size between the first and second wing parts 220*a* and 220*b*, a total mass of the suction valve 200 may be reduced.

Also, it is possible to increase a distance between a passage of a refrigerant suctioned through the first suction hole 133*a* when the first wing part 220*a* is opened and a passage of a refrigerant suctioned through the third suction hole 133*c* when the second wing part 200*b* is opened. Therefore, a flow resistance between the refrigerants may be reduced, thereby improving a suction performance of the refrigerant through the suction valve.

The suction valve 200 may include a curved portion 231*a* extending to be rounded and connecting the first edge portion 231 of the first wing part 220*a* and the first edge portion 231 of the second wing part 220*b*. As the curved portion 231*a* extends to be rounded, it is possible to prevent a stress from being concentrated on or at a point connecting the first edge part 231 of the first wing part 220*a* to the first edge part 231 of the second wing part 220*b*, thereby preventing damage to the suction valve 200.

According to embodiments disclosed herein, a compressor including internal parts or components may be decreased in size to reduce a volume of a machine room of a refrigerator, and thus, an inner storage space of the refrigerant may increase. Further, a drive frequency of the compressor may be increased to prevent the internal parts or components from being deteriorated in performance due to the decreased size thereof. In addition, the gas bearing may be applied between the cylinder and the piston to reduce a friction force occurring due to oil.

Also, the suction valve may be formed to have a relatively small thickness so as to improve a response performance of the suction valve while preventing the damage to the suction valve, and a mass of the suction valve may be reduced to thereby form a high natural frequency of the suction valve. In particular, the mass of the suction valve may be reduced by reducing the size of the opening/closing part of the suction valve and relatively increasing the size of the flow hole. Therefore, the movement of the suction valve corresponding to a high drive frequency of the linear compressor.

Also, four wing parts of the suction valve are provided in the vertical and horizontal directions, and an interval between the wing parts may gradually increase toward the outside direction of the suction valve, that is, the distance between the passages of the refrigerant suctioned through the plurality of suction holes of the piston increases. Therefore, a flow resistance of the refrigerant suctioned through different suction holes, thereby improving a performance of refrigerant suctioned through the suction valve.

Embodiments disclosed herein provide a linear compressor in which a response performance of a suction valve may be improved according to operations of the linear compressor driven at a high driving frequency. Embodiments disclosed herein also provide a linear compressor capable of reducing a mass of a suction valve so as to improve a response performance of the suction valve. Embodiments disclosed herein also provide a linear compressor capable of reducing a mass of a wing part or wing of a suction valve and reducing a flow resistance between refrigerants suctioned from a suction hole of a piston.

Embodiments disclosed herein provide a linear compressor that may include a suction valve with a plurality of wing parts or wings, each including two first edge portions extending in an outside direction of a fixing part or portion; and a second edge portion forming an outer circumferential portion of the wing part. A distance between a first edge portion provided in a first wing part or wing among the plurality of wing parts and a second edge portion provided in a second wing part or wing among the plurality of wing parts may gradually increase toward the outside of the suction valve.

The wing part may include two coupling parts or portions that extend from the fixing part in a radial direction; a cover part or cover that extends from the two coupling parts in the radial direction and covers the suction hole; and a flow hole defined between the two coupling parts. The wing part may include an inner circumferential portion defining an inner surface of the flow hole, and the inner circumferential portion may include a first inner circumferential surface forming an outer surface of the fixing part, and a second inner circumferential surface forming an inner surface of the cover part. The first inner circumferential surface and the second inner circumferential surface may be disposed or provided at positions facing each other, or may extend in parallel.

The inner circumferential portion may include a third inner circumferential surface forming an inner surface of one of the two coupling parts, and a fourth inner circumferential surface forming an inner surface of the other of the two coupling parts. The third inner circumferential surface and the fourth inner circumferential surface may be disposed or provided at positions facing each other, or may extend in parallel.

A shape of an outer surface of the wing and a shape of the flow hole may correspond to each other.

The suction valve may further include a curved portion extending to be rounded and connecting the first edge portion of the first wing part and the first edge portion of the second wing part.

The suction hole may be provided in plurality, the first wing part may cover some of the plurality of suction holes, and the second wing part may cover the others of the plurality of suction holes. The plurality of suction holes may include eight suction holes, and the plurality of wing parts may include four wing parts, each of which covers the two suction holes.

A drive frequency of the linear compressor may be in a range of about 80 Hz to about 110 Hz.

A thickness of the suction valve may be in a range of about 60 μm to about 80 μm.

The details of one or more embodiments are set forth in the accompanying drawings and the description. Other features will be apparent from the description and drawings, and from the claims.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor, comprising:

a piston having at least one suction hole through which a refrigerant is suctioned into a compression space; and a suction valve coupled to the piston to selectively open the at least one suction hole, wherein the suction valve includes a fixing portion having a valve coupling hole to which a valve coupling member is coupled and a plurality of wings that extends in an outer direction from the fixing portion, wherein each of the plurality of wings includes;

two first edge portions that extend from the fixing portion in the outer direction and a second edge portion forming an outer circumferential portion of the wing, wherein a distance between a first edge portion of a first wing among the plurality of wings and a first edge portion of a second wing among the plurality of wings gradually increases toward the outer direction of the suction valve;

two coupling portions that extend from the fixing portion in a radial direction;

a cover that extends from the two coupling portions in the radial direction and covers the suction hole; and an inner circumferential portion defining an inner surface of a flow hole formed between the two coupling portions, the inner circumferential portion including:

a first inner circumferential surface forming an outer surface of the fixing portion; and a second inner circumferential surface forming an inner surface of the cover.

2. The linear compressor according to claim 1, wherein the first inner circumferential surface and the second inner circumferential surface face each other.

3. The linear compressor according to claim 1, wherein the second inner circumferential surface and the second edge portion extend in parallel.

4. The linear compressor according to claim 1, wherein the inner circumferential portion further includes:

a third inner circumferential surface forming an inner surface of one of the two coupling portions; and a fourth inner circumferential surface forming an inner surface of the other of the two coupling portions.

5. The linear compressor according to claim 4, wherein the third inner circumferential surface and the fourth inner circumferential surface face each other.

6. The linear compressor according to claim 4, wherein the third inner circumferential surface and the fourth inner circumferential portion extend in parallel respectively to the first edge portion of the respective wing.

7. The linear compressor according to claim 4, wherein the third inner circumferential surface and the fourth inner circumferential surface has a same length.

8. The linear compressor according to claim 1, wherein a shape of an outer surface of the wing and a shape of the flow hole correspond to each other.

9. The linear compressor according to claim 1, wherein a point at which an extension line of the first edge portion of the first wing and an extension line of the first edge portion of the second wing meet each other forms an edge central portion, and an angle between the first edge portion of the first wing and the first edge portion of the second wing forms a predetermined angle (θ) with respect to the edge central portion.

10. The linear compressor according to claim 9, wherein the predetermined angle (θ) is determined within a range of about 30° to about 70°.

11. The linear compressor according to claim 9, wherein a distance between the first edge portion of the first wing and the first edge portion of the second wing at a point which is spaced apart from the edge central portion by a first predetermined distance forms a first separation distance, a distance between the first edge portion of the first wing and the first edge portion of the second wing at a point which is spaced apart from the edge central portion by a second predetermined distance forms a second separation distance, the second predetermined distance is greater than the first predetermined distance, and the second separation distance is greater than the first separation distance.

12. The linear compressor according to claim 1, wherein the suction valve further includes a curved portion that extends to be rounded and connects the first edge portion of the first wing and the first edge portion of the second wing.

13. The linear compressor according to claim 1, wherein the at least one suction hole includes a plurality of suction holes, the first wing covers some of the plurality of suction holes, and the second wing covers the others of the plurality of suction holes.

14. The linear compressor according to claim 13, wherein the plurality of suction holes includes eight suction holes, and the plurality of wings includes four wings, each of which covers two of the eight suction holes.

15. The linear compressor according to claim 1, wherein a drive frequency of the linear compressor is in a range of about 80 Hz to about 110 Hz.

16. The linear compressor according to claim 15, wherein a thickness of the suction valve is in a range of about 60 μm to about 80 μm.

17. A linear compressor, comprising:

a piston having a plurality of suction holes through which a refrigerant is suctioned into a compression space; and a suction valve coupled to the piston to selectively open plurality of suction holes, wherein the suction valve includes a fixing portion by which the suction valve is coupled to the piston, and a plurality of wings that extends in an outer direction from the fixing portion, wherein each of the plurality of wings includes;

two first edge portions that extend from the fixing portion in the outer direction and a second edge portion forming an outer circumferential portion of the wing, wherein a distance between a first edge portion of a first wing among the plurality of wings and a first edge portion of a second wing among the plurality of wings gradually increases toward the outer direction of the suction valve;

two coupling portions that extend from the fixing portion in a radial direction;

a cover that extends from the two coupling portions in the radial direction and covers at least one suction hole of the plurality of suction holes; and a flow hole defined between the two coupling portions, wherein the flow hole is defined by;

a first inner circumferential surface forming an outer surface of the fixing portion;

a second inner circumferential surface extending in parallel with the first inner circumferential surface; and third and fourth inner circumferential surfaces forming inner surfaces of the two coupling portions.

* * * * *